US006572929B2

(12) United States Patent
Holzer, Jr. et al.

(10) Patent No.: US 6,572,929 B2
(45) Date of Patent: Jun. 3, 2003

(54) APPARATUS AND METHODS FOR APPLYING LIQUID FINISH TO SYNTHETIC FILAMENTS

(75) Inventors: Carl R. Holzer, Jr., Anderson, SC (US); Richard T. Phelps, III, Greenville, SC (US); Gary W. Hanwell, Anderson, SC (US)

(73) Assignee: BASF Corporation, Mt. Olive, NJ (US)

( * ) Notice: Subject to any disclaimer, the term of this patent is extended or adjusted under 35 U.S.C. 154(b) by 113 days.

(21) Appl. No.: 09/758,950

(22) Filed: Jan. 12, 2001

(65) Prior Publication Data

US 2002/0092469 A1 Jul. 18, 2002

(51) Int. Cl.[7] ..... B05D 1/18
(52) U.S. Cl. ..... 427/434.6; 118/234
(58) Field of Search ..... 65/529, 547, 550; 118/234, 216, 412, 225, 246, 249, 250, 255, 420; 427/434.6, 428; 8/151.2, 151.1; 68/203, 202

(56) References Cited

U.S. PATENT DOCUMENTS 2,568,446 A * 9/1951 Griffin ..... 118/234
2,673,546 A * 3/1954 Newton ..... 118/234
3,304,862 A * 2/1967 Lawrence et al. ..... 68/203
3,401,542 A * 9/1968 Evans ..... 118/234
3,862,853 A * 1/1975 Benson
4,046,099 A * 9/1977 Komatsu ..... 68/203
4,109,610 A * 8/1978 Parbhoo ..... 118/420
5,679,158 A 10/1997 Holzer, Jr. et al. ..... 118/407

* cited by examiner

*Primary Examiner*—Brenda A. Lamb
(74) *Attorney, Agent, or Firm*—Nixon & Vanderhye PC

(57) ABSTRACT

Liquid finish is applied to a travelling filament by bringing the travelling filament into contact with an arcuate surface portion associated with a normally stationary, but rotatable, annular finish applicator, and thereafter periodically rotating the annular finish applicator to bring at least one other arcuate surface portion thereof into contact with the travelling filament. Most preferably, an actuator assembly is provided having first and second actuator fingers which are capable of relative separable rectilinear movements towards and away from one another. These actuator fingers, in an especially preferred embodiment, are each pivotally moveable and magnetically coupled to one another. As such, separable movement will in turn cause that one of the actuator fingers connected to the annular finish applicator to pivot thereby rotating the later to expose a "fresh" arcuate surface region in contact with the filament.

23 Claims, 7 Drawing Sheets

APPARATUS AND METHODS FOR APPLYING LIQUID FINISH TO SYNTHETIC FILAMENTS

FIELD OF THE INVENTION

The present invention relates generally to the field of synthetic filament production. More specifically, the present invention relates to the field of liquid finish applicators and methods whereby a liquid finish is applied onto surfaces of synthetic filaments.

BACKGROUND AND SUMMARY OF THE INVENTION

Synthetic filaments are traditionally produced by various spinning techniques. For example, synthetic filaments may be melt-spun by extruding a melt-spinnable polymer through relatively small-sized orifices in a spin pack to form a stream of filaments that is substantially immediately solidified in a quench cabinet. The filaments are thereafter continuously taken up by a high speed winder to form a generally cylindrical package. Depending on the intended end use, the filaments may be undrawn or may be subjected to a drawing step prior to being taken up to form the package.

The solidified filaments are typically passed through a metered finish applicator, which applies a liquid finish material (colloquially referred to as a "finish oil") so as to lubricate the filaments to reduce filamentary friction and/or to achieve desired processability characteristics. Typically, a finish applicator mounting unit supports a plurality of fixed-position finish applicator nozzles that each include a slot to receive the individual filament threadlines. A portion of the slot against which the filaments are guided includes a small opening for the finish oil. Thus, as the filaments pass through the finish applicator nozzle during production, the finish oil is supplied to the slot and thereby coated onto the filaments.

The finish applicator nozzles are typically formed of a durable, low friction material, such as a ceramic material. Over time, however, the small amount of friction between the filaments moving at a relatively high speed and the stationary finish applicator nozzle causes some wear to be experienced in the latter. A greater amount of friction on the moving filaments will result as the finish applicator nozzle experiences greater wear which, in turn, is detrimental to the filaments. Too great a frictional force against the filaments can, in extreme cases, cause filament breakage requiring production down time.

Recently, U.S. Pat. No. 5,679,158 (the entire content of which is expressly incorporated hereinto by reference) suggested providing a finish applicator assembly with applicator nozzles removably received in a corresponding aperture of a mounting unit. While the applicator nozzles of this U.S. '158 patent are more easily accessible for the purpose of cleaning, repair and/or replacement, some improvements are still desired.

For example, it would especially be desirable for finish applicators and methods to be provided which would increase the wearability of the finish applicator thereby lessening the friction experienced between the applicator and the moving filaments over a significantly greater period of time than can now be accomplished. It is towards fulfilling such a need that the present invention is directed.

Broadly, the present invention is embodied in apparatus and methods whereby a finish oil may be applied onto a moving filament by a stationary, yet periodically movable finish applicator. The finish applicator is most preferably annular and is thus capable of being rotated relative to the traveling filament so as to sequentially bring at least one and another arcuate applicator surface segments into contact with the travelling filament. By continually exposing different surface segments of the finish applicator to filament contact at different times, the amount of wear experienced by a single one of the surface portions is minimized. As such, the finish applicator is capable of being kept in production for prolonged time periods and thus minimizes (if not eliminates entirely) at least some of the problems noted previously with respect to conventional finish applicators.

Thus, in one especially preferred aspect of the present invention, liquid finish is applied to a travelling filament by bringing the travelling filament into contact with an arcuate surface portion associated with a normally stationary, but rotatable, annular finish applicator, and thereafter periodically rotating the annular finish applicator to bring at least one other arcuate surface portion thereof into contact with the travelling filament. Most preferably, an actuator assembly is provided having first and second actuator fingers which are capable of relative separable rectilinear movements towards and away from one another. These actuator fingers, in an especially preferred embodiment, are each pivotally moveable and magnetically coupled to one another. As such, separable movement will in turn cause that one of the actuator fingers connected to the annular finish applicator to pivot thereby rotating the later to expose a "fresh" arcuate surface region in contact with the filament.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
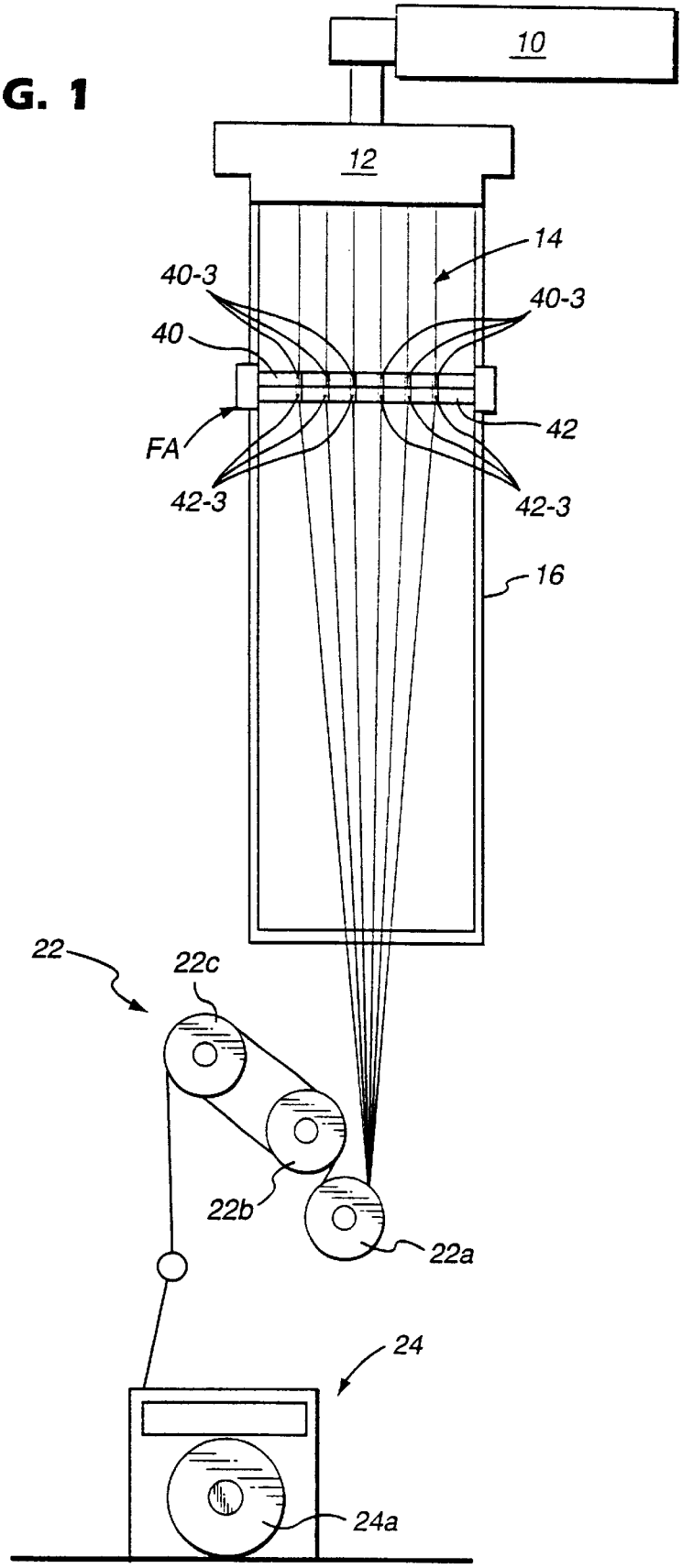
FIG. 1 is a schematic illustration of a melt spinning system in which the finish applicator assembly of the present invention may be employed.

In a typical melt spinning apparatus as shown in FIG. 1, an extruder 10 extrudes a polymer melt through a spin pack 12 having a plurality of spinneret orifices that form a plurality of filament threadlines 14. It will be understood that, depending on the intended end use, each of the threadlines may include a single filament or may include any number of filaments forming a yarn. The filament threadlines 14 are first cooled in a quench cabinet 16 and may thereafter be drawn by a drawing assembly 22, comprised of godet rolls 22*a*–22*c*. The finished filaments are then wound by a high speed winder 24 to form a package 24*a*. Prior to being taken up by the winder 24, the filament threadlines 14 may be brought into contact with a finish applicator FA according to this invention so that finish oil may be applied.

As is more clearly depicted in accompanying FIGS. 2A–2C and 3A–3C, the finish applicator FA includes a base frame 32 supporting opposed pairs of upright frame members 32, 34. Upper and lower pairs of guide rods 36, 38 span the distance between, and are thus supported by, the upright frame members 32, 34. Extending transversely between these guide rods 36, 38 are a finish applicator roll 40 and a filament guide roll 42, each being mounted for rotational movement about its respective longitudinal axis. In this regard, cross-support members 44, 46 extend between the opposed pairs of upper and lower guide rods 36, 38 and are slidably coupled thereto by bushings 44-1 and 46-1 and slide blocks 44-2 and 44-2 at respective ends thereof. The rolls 40, 42 are carried by the transverse supports 44, 46 by means of one-way clutch bearings 40-1, 42-1, respectively (see FIGS. 3A–3C), the purpose of which will be explained in greater detail below.

A pair of actuator fingers 40-2, 42-2 are connected operatively to their respective clutch bearing 40-1, 42-1 and extend radially outwardly therefrom in a generally opposed direction relative to one another. Most preferably the actuator fingers 40-2 and 42-2 are magnetically attracted to one another so as to be magnetically coupled when in contact, the purpose of which will be explained in greater detail below. The bushings 44-1, 46-1 and slide blocks 44-2, 46-2 allow the cross-support members 44, 46 and the rolls 40, 42 carried thereby, to be moved reciprocally along the guide rods 36, 38, respectively. The slide block 44-2 is most preferably positioned relative to the filament threadlines 14 during start-up and fixed in place (e.g., by clamping) to the guide rods 36. Thereafter, in use, the slide block 44-2 (and thus roll 40) remains stationary while the slide block 46-2 is capable of being moved reciprocally along the guide rods 38 so as to move the roll 42 carried thereby towards and away from the roll 40.

The rolls 40, 42 are provided with a series of annular finish applicator and guide slots (a representative few of which are identified in FIGS. 2A–2C by reference numerals 40-3, 42-3, respectively) which are spaced apart from one another along the longitudinal axis of the rolls 40, 42. Each of the annular applicator and guide slots 40-3, 42-3, respectively, is most preferably formed of a ceramic material so as to minimize friction against the travelling filaments in contact therewith. A series of finish applicator nozzles 48 are removably supported by the cross-support member 44 so as to be in registry with a respective one of the annular applicator slots 40-3. The applicator nozzles 48 are fluid-connected to a source of liquid finish (not shown) so that the liquid finish material may be supplied to, and discharged from, the nozzles 48 onto each respective annular applicator slot 40-3. Filament strands 14 in contact with the annular applicator slots 40-3 will thus be coated with the liquid finish supplied thereto by means of the nozzles 48. A drain tray 50 is positioned below the annular applicator slots 40-3 so as to receive excess liquid finish.

Figure 2A:
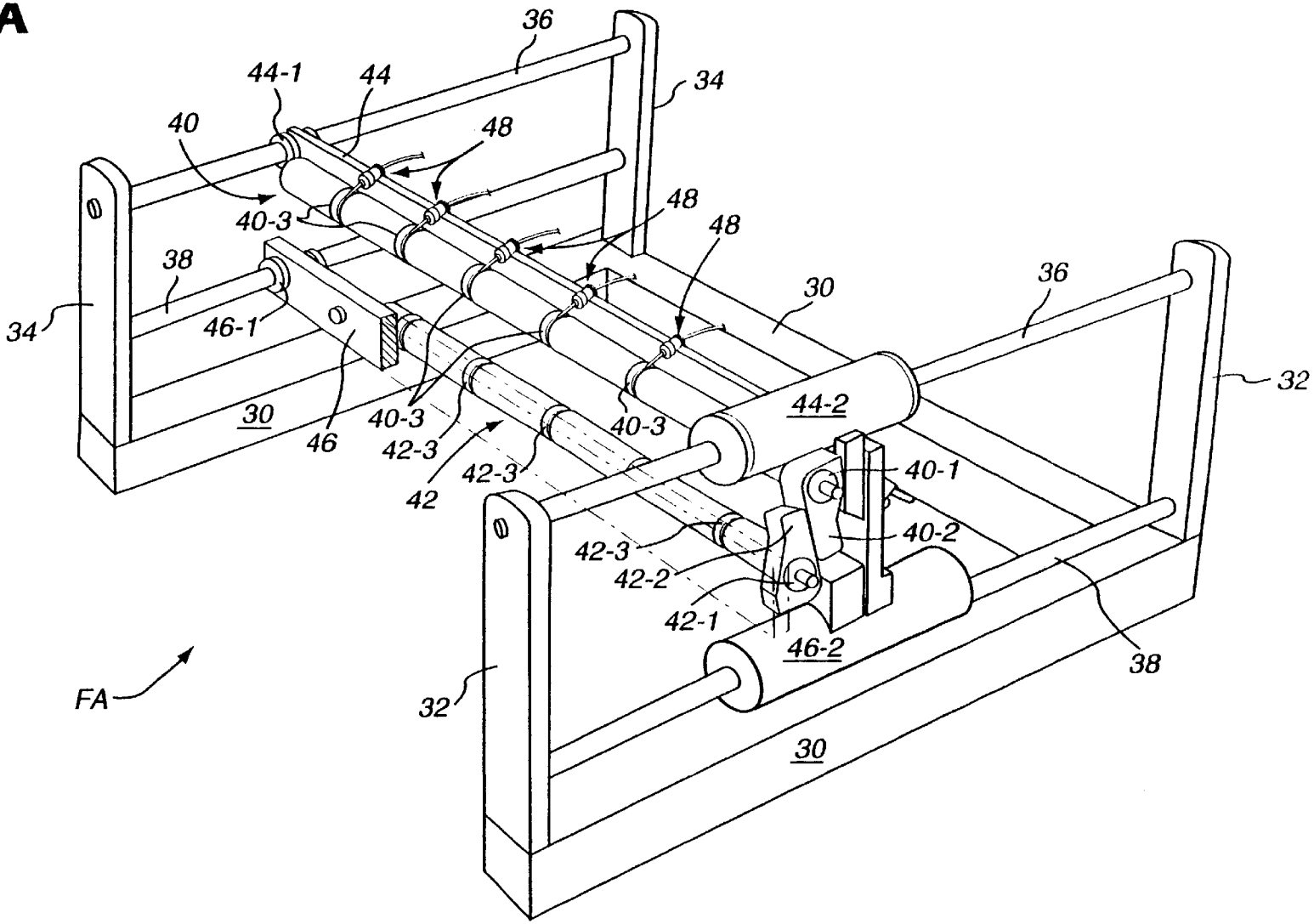
FIGS. 2A through 2C are perspective views of a preferred embodiment of a finish applicator assembly of the present invention at different operational stages.
Figure 3A:
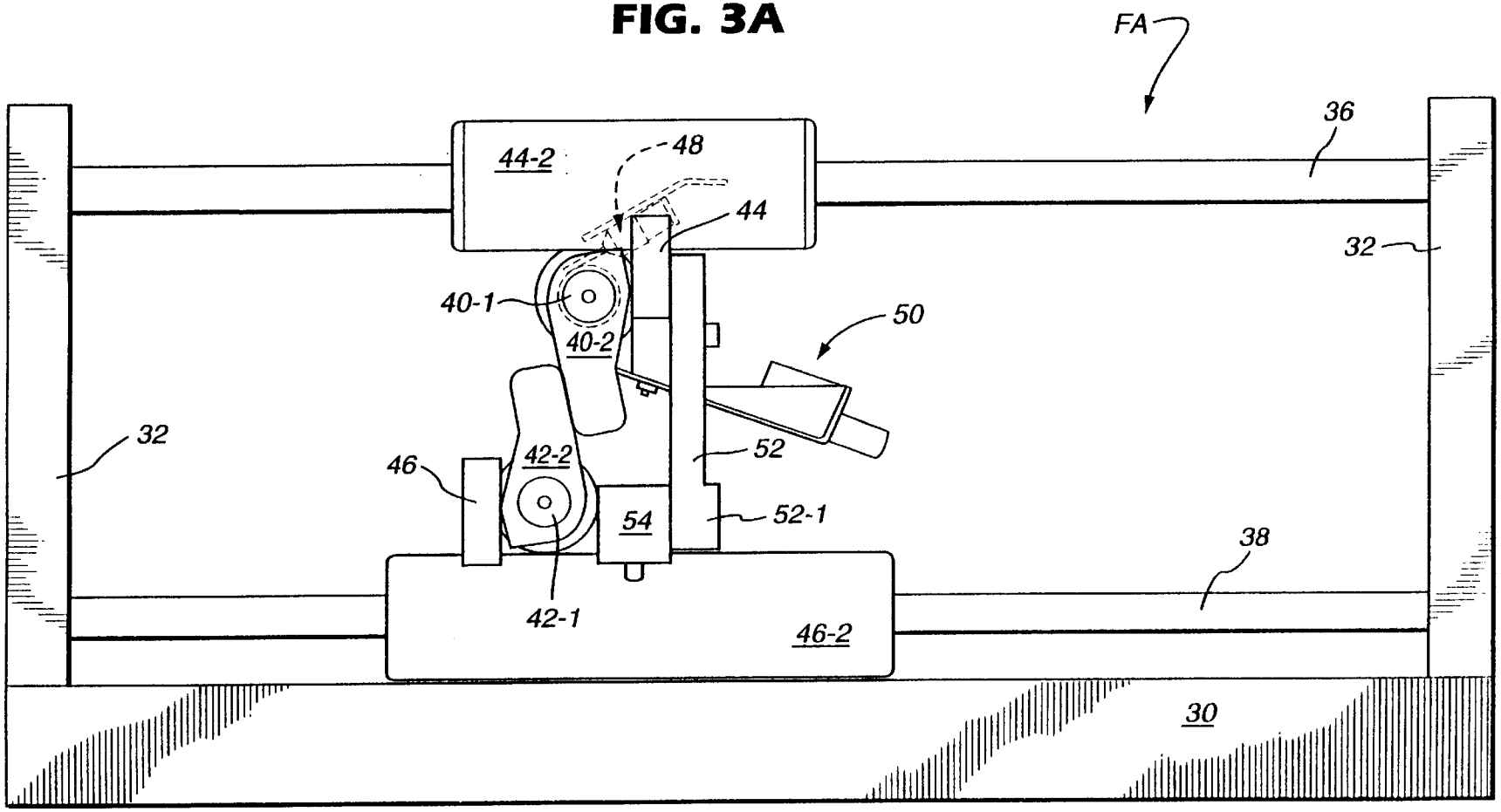
FIGS. 3A through 3C are end elevational views of the finish applicator assembly at different operational stages corresponding to FIGS. 2A through 2C, respectively.

In use, filament threadlines 14 will be positioned in contact around a forward surface portion of a respective annular applicator slot 40-3 and a rearward surface portion of a respective annular guide slot 42-3. The individual filament strands 14 will thus be in contact along a selected arcuate segment (known as the "wrap angle") of the annular and 25 applicator slots 40-3, 42-3. This wrap angle may, however, be changed by reversing the stop arm 52 which depends from, and is carried by, the cross-support 44. That is, as is perhaps more clearly shown in FIGS. 3A–3B, a stop 54 carried by the slide block 46-2 is normally in contact with the lower end of the stop arm 52. If the stop arm 52 is reversed, the larger boss at the terminal end 52-1 thereof will thus be in contact with the stop 54 thereby increasing the horizontal separation distance between the rolls 40, 42 (and thereby decreasing the wrap angle of the filaments around the annular applicator and guide slots 40-3, 42-3, respectively). Most preferably, the stop 54 is magnetized so as to be magnetically coupled to the stop arm 52 when in contact therewith. Magnetic coupling between the stop 52 and stop arm 54 will thus maintain the rolls 40, 42 (and the actuator fingers 40-2, 42-2) in their normal operative positions as depicted in FIGS. 2A and 3A during the filament spinning operation.

Periodically in the filament production cycle, there is a need to doff the yarn packages 24*a*. During such time, the threadlines will be directed "off-line" prior to restringing onto a fresh yarn package core. At this time, an operator will separate the rolls 40 and 42 in a horizontal dimension by sliding the slide block 46-2 rectilinearly along the guide rods 38 in the direction of arrow A1 (see FIGS. 3B and 3C). The roll 42 will thus move away from roll 40 thereby increasing the horizontal separation distance therebetween. Each of the actuator fingers 40-2, 42-2 will, in response to such rectilinear movement of the slide block 46-2, rotate in the directions of arrows A2 and A3 (see FIG. 3B), respectively, due to the magnetic coupling therebetween.

As noted previously, the actuator fingers 40-2, 42-2 are connected operatively to one-way clutch bearings 40-1, 42-1, respectively. Thus, when the actuator fingers 40-2, 42-2 are rotated in the directions of arrows A2 and A3, the one-way clutch bearings 40-1, 42-1 will responsively "free-wheel". As a result, the rolls 40, 42 will not rotate in response to rotation of the actuator fingers 40-2, 42-2 in the direction of arrows A2 and A3. In other words, the one-way clutch bearings 40-1, 40-2 will cause the rolls 40, 42 to rotate only in response to rotation of the actuator fingers 40-2, 42-2 in a direction opposite to arrows A2 and A3 as will be explained in greater detail below.

Figure 2B:
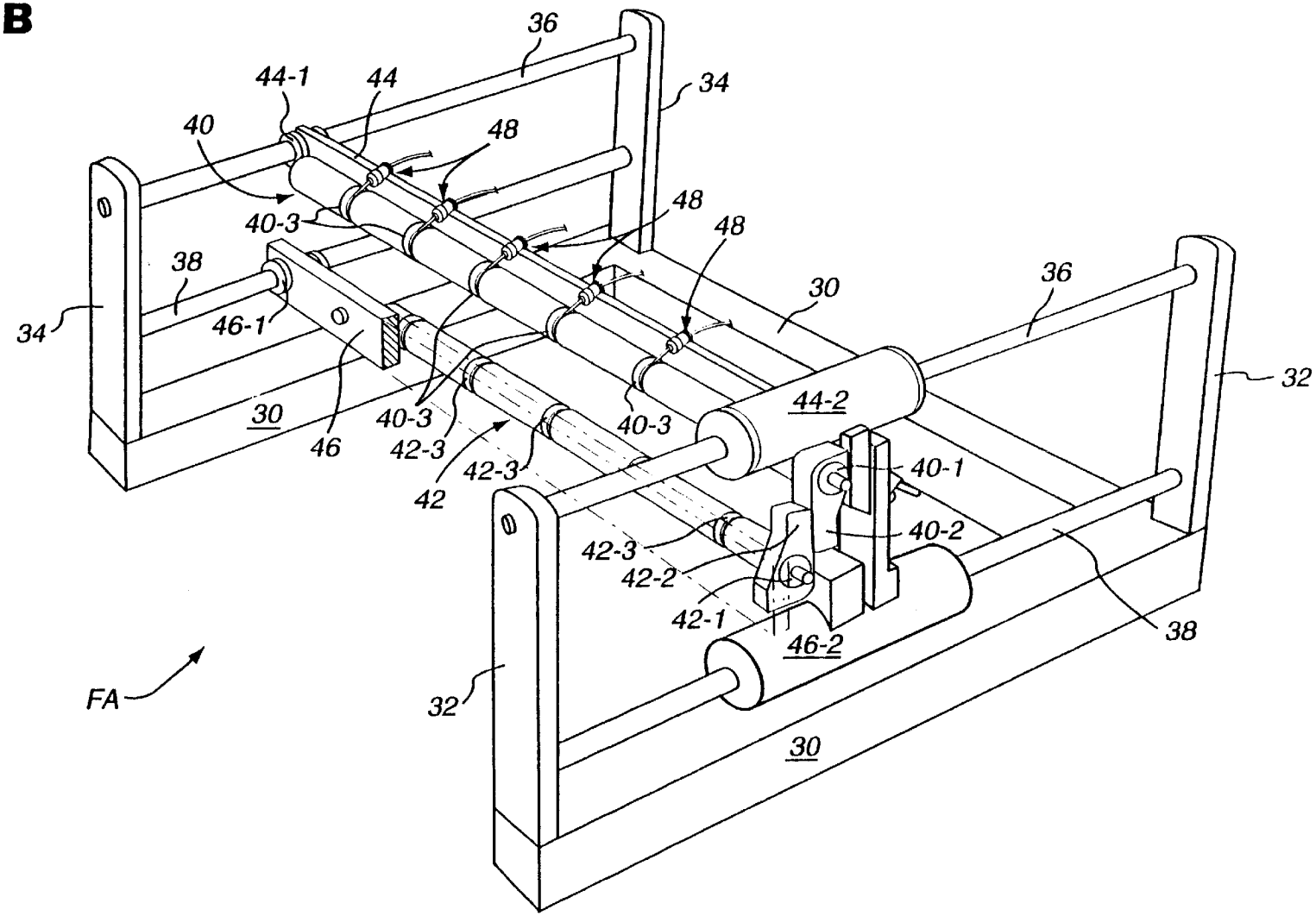
Figure 2C:
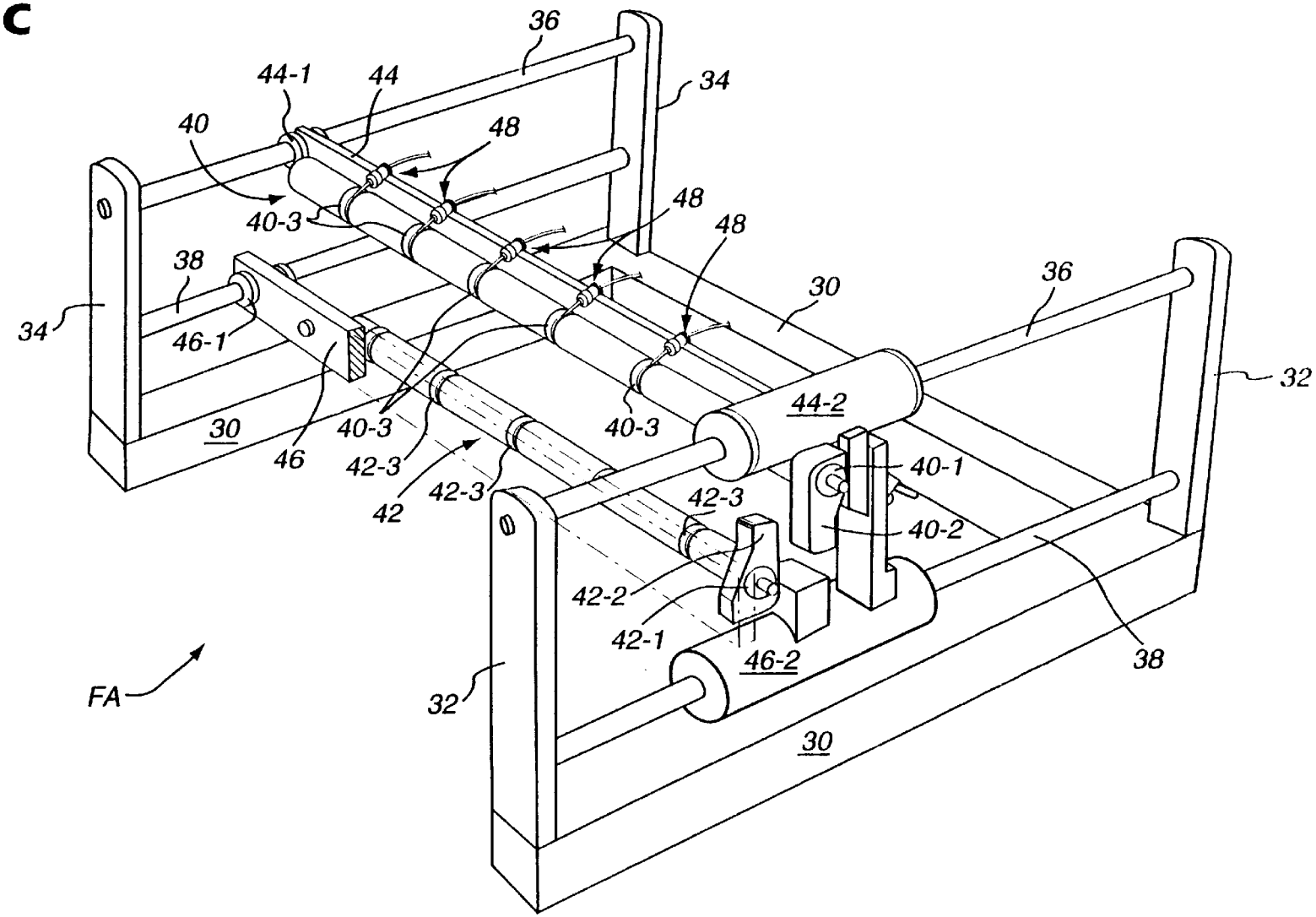
Figure 3B:
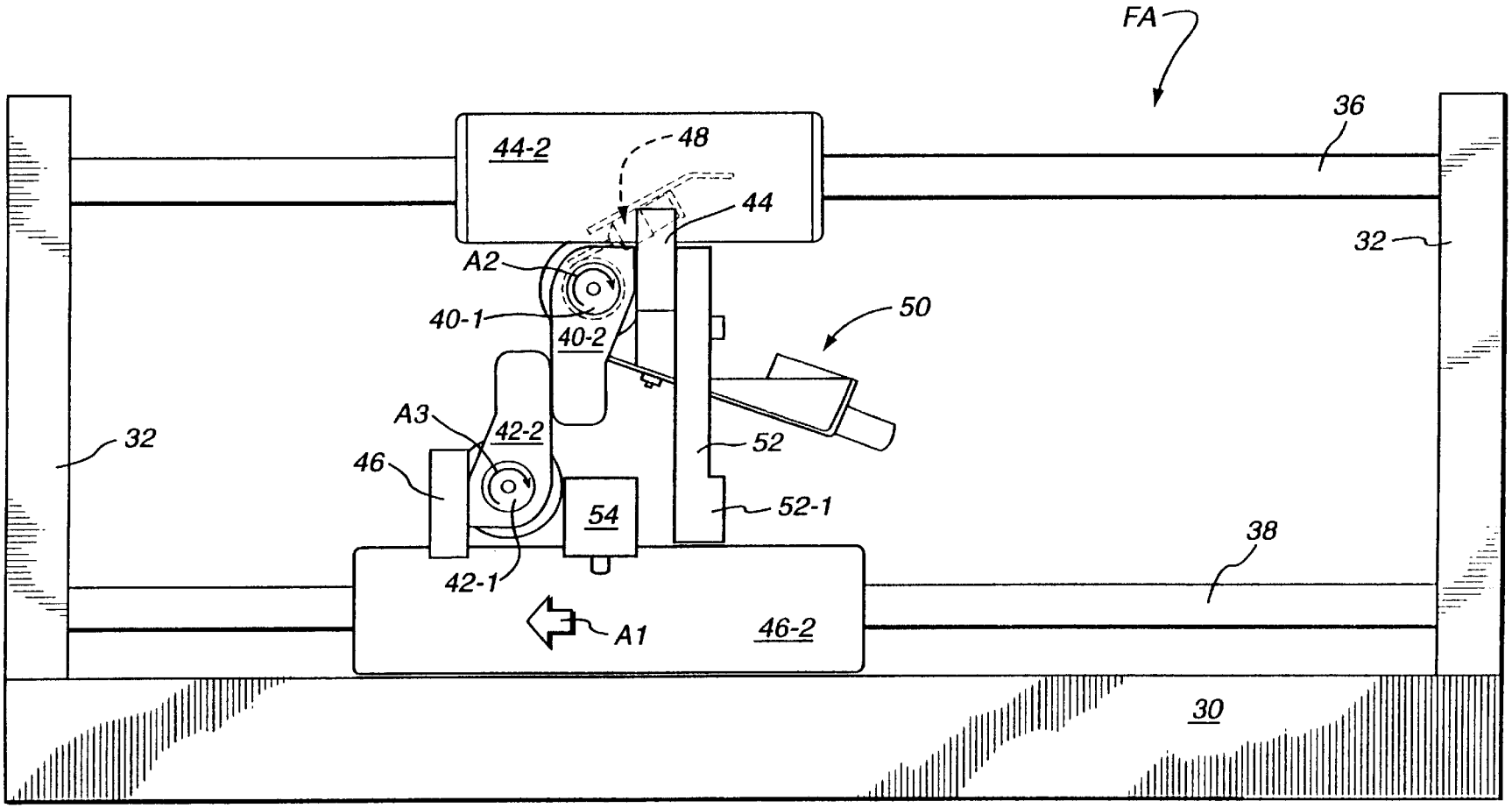
Figure 3C:
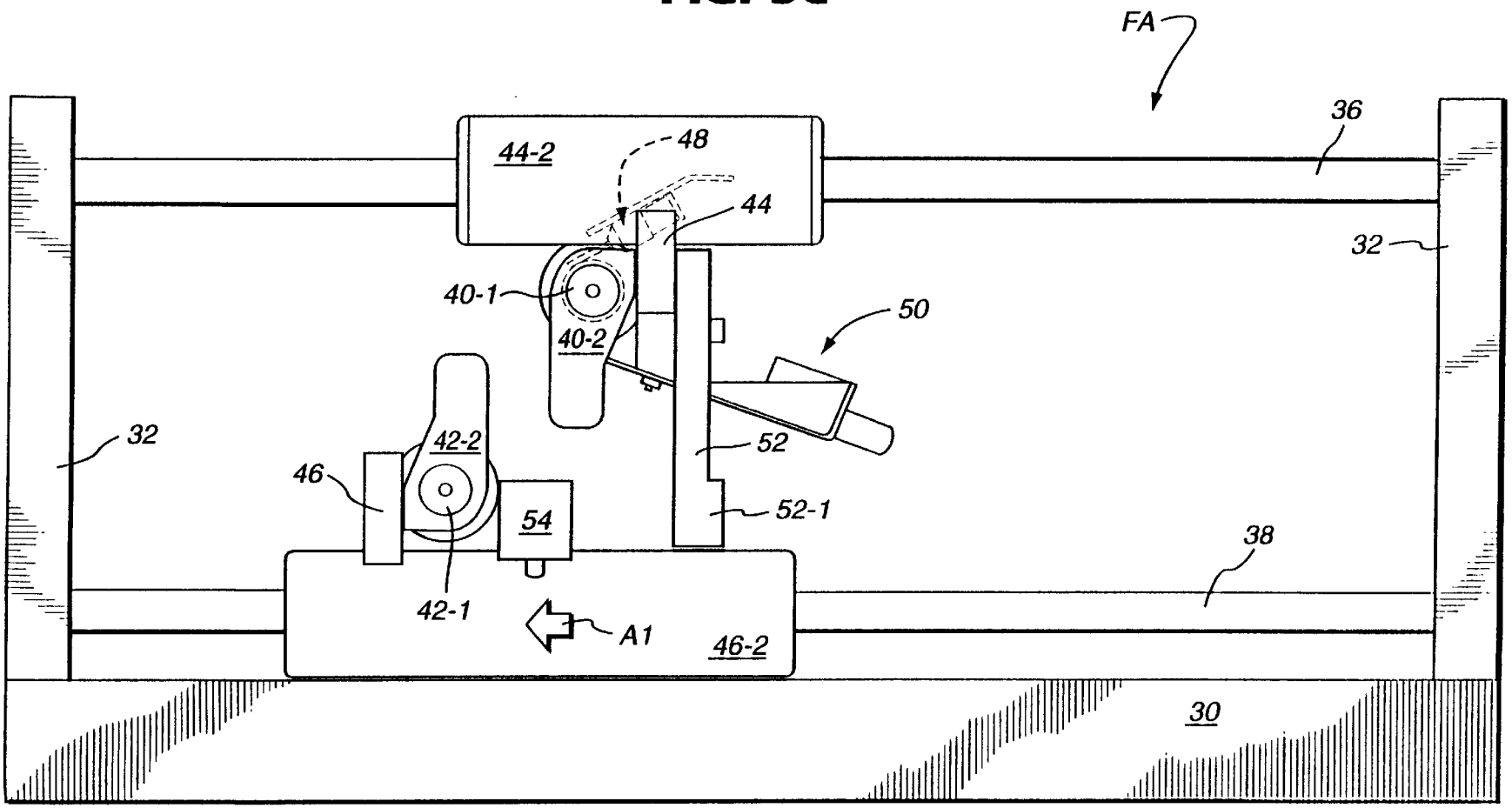

Continued movement of the slide block 46-2 (i.e., in the direction of arrow A1 from the state depicted in FIGS. 2B and 3B) will thus cause the actuator fingers 40-2, 42-2 to physically separate from one another as depicted in FIGS. 2C and 3C. In such a state, the threadlines 14 may be more easily re-strung.

Following re-stringing of the filament threadlines 14, the slide block 46-2 may be rectilinearly moved along guide rod 38 toward roll 40 (i.e., in a direction opposite to arrow A1 in FIGS. 3B and 3C). The actuator fingers 40-2, 42-2 will thus again be brought into contact with one another as shown in FIG. 3B. As a result of continued movement of the slide block 46-2 in a direction opposite to arrow A1, the actuator fingers 40-2, 42-2 to be rotated in a direction opposite to arrows A2 and A3, respectively. However, rotation of the actuator fingers 40-2 and 42-2 in directions opposite to arrows A2 and A3, respectively, will cause the rolls 40, 42 to be driven in the same rotational direction by virtue of the interconnection of the fingers 40-2, 42-2 with their respective one-way clutch bearing 40-1, 42-1. The surfaces of the annular applicator and guide slots 40-3, 42-3 which are exposed to the filament strands 14 upon subsequent re-stringing will thus be changed. As a result, fresh surfaces of the annular applicator and guide slots 40-3, 42-3 will be presented to the threadlines 14.

It will be understood that the description of the rotation of the rolls 40, 42 (and hence the annular applicator and guide slots 40-3, 42-3 carried thereby) as being rotated only when the actuator fingers 40-2,. 42-2 are rectilinearly advanced toward one another represents a presently preferred embodiment of the present invention. Thus, it is entirely possible in accordance with the present invention that the rolls 40, 42 (and hence the annular applicator and guide slots 40-3, 42-3 carried thereby) may be rotated during relative rectilinear separation of the actuator fingers 40-2, 42-2, depending on the operation of the one-way clutch bearings 401 and 42-1, respectively. Furthermore, if desired, the magnetic coupling of the actuator fingers could be employed in the absence of a one-way clutch bearing to cause rotation of the rolls 40, 42 (and hence the annular applicator and guide slots 40-3, 42-3 carried thereby) in response to the actuator fingers 40-2, 42-2 being rectilinearly advanced and retracted relative to one another. Suffice it to say here, therefore, that one skilled in this art may recognize that a variety of substantially equivalent structures may be provided to achieve substantially the same result in substantially the same way as described above.

Furthermore, although one-way clutch bearings have been described in detail above, it will be understood that they also presently represent the most preferred embodiment of the invention. Thus, a variety of equivalent arrangements to achieve one-way roll rotation can be envisioned, such as, for example, a pawl and ratchet assembly, cooperating rollers, rack and pinion systems, torsional spring systems and the like. Furthermore, it will be understood that the guide roll 42, although presently preferred, is not absolutely necessary in order to impart a liquid finish to filament surfaces. Thus, only the roll 40 may be provided in a finish applicator in accordance with the present invention, in which case, the actuator finger 40-2 may be contacted by a rotational or stationary magnetic finger member associated with a slide-block actuator or by any of the equivalent means noted above.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for applying a liquid finish to a travelling filament comprising:

a rotatable annular applicator;

a finish nozzle for supplying liquid finish to the annular applicator; and an actuator assembly for allowing periodic rotation of said annular applicator to expose at least first and second arcuate surface regions thereof to contact with the travelling filament, wherein said actuator assembly includes a rectilinearly movable actuator member, and a motion translation coupling which translates rectilinear movement of said actuator member into rotational movement of said annular applicator.

2. The apparatus of claim 1, wherein said actuator assembly includes a first actuator finger, a one-way rotational coupling connecting said first actuator finger to said annular applicator, and a second actuator finger associated operatively with said rectilinearly moveable actuator member.

3. The apparatus of claim 2, wherein said first and second actuator fingers are independently pivotally moveable, said first and second actuator fingers being coupled to one another to cause rotation of said annular applicator through said one-way rotational coupling in response to rectilinear movement of said actuator member in a first direction.

4. The apparatus of claim 3, wherein said first and second actuator fingers are magnetically coupled to one another.

5. Apparatus for applying a liquid finish onto a traveling filament comprising:

a rotatable annular applicator;

a finish nozzle for supplying liquid finish to the applicator; and an actuator assembly which periodically rotates said annular applicator so as to expose at least first and second arcuate surface regions of said applicator to contact with the travelling filament, whereby applicator wear is minimized, wherein said applicator assembly includes:

(i) a first actuator finger capable of rotational movements in first and second opposite rotational directions;

(ii) a one-way rotational coupling for coupling said first actuator finger to said applicator so that said applicator is rotated only when said first actuator finger is rotated in said first rotational direction thereof and not in said second rotational direction; and (iii) a second actuator finger which is rectilinearly moveable between first and second positions relative to said first actuator finger, said second actuator finger responsively causing said first actuator finger to rotate between said first and second rotational directions in response to rectilinear movements thereof between said first and second positions, respectively, thereby rotating said annular applicator.

6. The apparatus of claim 5, wherein said first and second actuator fingers are magnetically coupled to one another during at least a portion of said rectilinear movement of said first actuator finger from said first position and into said second position thereof.

7. The apparatus of claim 5, further comprising an annular guide in registry with said annular applicator.

8. The apparatus of claim 7, further comprising a second one-way coupling member which couples said second actuator finger to said annular guide.

9. The apparatus of claim 5, comprising an applicator roll which includes multiple coaxial annular applicators spaced-apart from one another along the applicator roll.

10. An apparatus for applying a liquid finish onto a traveling filament comprising:

an annular applicator;

a finish nozzle for supplying liquid finish to the applicator; and first and second rectilinearly separable and independently rotatable actuator fingers, wherein said first actuator and second actuator fingers are magnetically coupled to one another to cause said first and second actuator fingers to rotate as a unit in a first rotational direction in response to rectilinear movement of said second actuator finger between first and second positions thereof.

11. The apparatus of claim 10, further comprising a stop element to establish a normal position between said first and second actuator fingers.

12. The apparatus of claim 11, wherein said stop element includes a first stationary stop member and a second stop member which is rectilinearly moveable with said second actuator finger.

13. The apparatus of claim 12, wherein said first and second stop members are magnetically coupled to one another when said first and second actuator members are in said normal position.

14. Apparatus for applying a liquid finish onto multiple traveling filaments comprising:

a rotatable applicator roll having a plurality of fixed-position, longitudinally spaced-apart annular applicator slots for receiving a respective one of said travelling filaments;

a plurality of finish nozzles each for supplying liquid finish individually to a respective one of said annular applicator slots; and an actuator assembly which periodically rotates said applicator roll, and hence said annular applicator slots associated therewith, between at least first and second stationary positions relative to said travelling filaments so that said traveling filaments contact at least first arcuate surface regions of said applicator slots during a first operational period, and thereafter contact second arcuate surface regions of said applicator slots during a second operational period, whereby applicator wear is minimized.

15. The apparatus of claim 14, wherein said applicator assembly includes:

(i) a first actuator finger capable of rotational movements in first and second opposite rotational directions;

(ii) a one-way rotational coupling for coupling said first actuator finger to said applicator so that said applicator is rotated only when said first actuator finger is rotated in said first rotational direction thereof and not in said second rotational direction; and (iii) a second actuator finger which is rectilinearly moveable between first and second positions relative to said first actuator finger, said second actuator finger responsively causing said first actuator finger to rotate between said first and second rotational directions in response to rectilinear movements thereof between said first and second positions, respectively, thereby rotating said annular applicator.

16. The apparatus of claim 15, further comprising a guide roll comprising a plurality of longitudinally spaced-apart annular guide slots each being in registry with a respective one of said annular applicator slots.

17. A method of applying liquid finish to a travelling filament comprising the steps of:

(a) bringing the travelling filament into contact with an arcuate surface portion associated with a normally stationary, but rotatable, annular finish applicator;

(b) supplying liquid finish to the annular finish applicator to allow at least a portion thereof to be coated onto said travelling filament; and (c) periodically rotating said annular finish applicator to bring at least one other arcuate surface portion thereof into contact with said travelling filament by pivotally moving an actuator finger connected operatively to said annular finish applicator in a first pivotal direction.

18. The method of claim 17, wherein step (c) includes magnetically coupling an actuator member to said pivotally moveable actuator finger, and thereafter rectilinearly moving said actuator member in a separable direction relative to said actuator finger to thereby cause said actuator finger to pivot in said first pivotal direction.

19. The method of claim 17, further comprising positioning an annular guide in downstream alignment with said annular finish applicator.

20. The method of claim 19, further comprising coupling said annular guide to said annular finish applicator so that rectilinear movements of said annular guide will responsively rotate said annular finish applicator, and wherein step (c) is practiced by periodically rectilinear moving said annular guide towards and away from said annular finish applicator to responsively periodically rotate the same.

21. A method of applying liquid finish to a travelling filament comprising the steps of:

(a) bringing the travelling filament into contact with an arcuate surface portion associated with a normally stationary, but rotatable, annular finish applicator having a first actuator finger connected thereto which is magnetically coupled to a rectilinearly moveable second actuator finger;

(b) supplying liquid finish to the annular finish applicator to allow at least a portion thereof to be coated onto said travelling filament; and (c) periodically rectilinearly moving said second actuator finger relative to said first actuator finger and thereby rotate said annular finish applicator to bring at least one other arcuate surface portion thereof into contact with said travelling filament.

22. The method of claim 21, further comprising positioning an annular guide in downstream alignment with said annular finish applicator which is connected operatively to said second actuator finger, and then moving said annular guide rectilinearly towards and away from said annular finish applicator with said first and second actuator members magnetically coupled to one another.

23. The method of claim 22, comprising allowing said second actuator finger to pivot concurrently with said first actuator finger to thereby cause said annular guide to rotate.

* * * * *